US006420656B1

(12) United States Patent
Sugiyama et al.

(10) Patent No.: US 6,420,656 B1
(45) Date of Patent: Jul. 16, 2002

(54) INSULATED WIRE HAVING SPIRAL END AND METHOD FOR CONNECTING THE SAME

(75) Inventors: Hiroyasu Sugiyama, Kanuma; Yoshifumi Kawata; Kyuzo Suzuki, both of Tokyo, all of (JP)

(73) Assignees: Sumitomo Electric Industries, Ltd., Osaka; Sumideninet Co., Ltd., Tokyo, both of (JP)

( * ) Notice: Subject to any disclaimer, the term of this patent is extended or adjusted under 35 U.S.C. 154(b) by 0 days.

(21) Appl. No.: 09/512,257

(22) Filed: Feb. 24, 2000

(30) Foreign Application Priority Data

Feb. 25, 1999 (JP) ..... 11-047570

(51) Int. Cl.[7] ..... H01B 7/00
(52) U.S. Cl. ..... 174/110 R; 439/841
(58) Field of Search ..... 174/110 R, 94 R, 174/267; 29/860; 439/880, 840, 841

(56) References Cited

U.S. PATENT DOCUMENTS 3,008,119 A * 11/1961 Swengel ..... 439/880
3,456,339 A * 7/1969 Small ..... 29/860
3,663,741 A * 5/1972 Cushman ..... 174/94 R

FOREIGN PATENT DOCUMENTS

| | | |
|---|---|---|
| JP | 50-150887 | 12/1975 |
| JP | 53-96489 | 8/1978 |
| JP | 55-69910 | 5/1980 |

* cited by examiner

*Primary Examiner*—Chau N. Nguyen
(74) *Attorney, Agent, or Firm*—Smith, Gambrell & Russell, LLP

(57) ABSTRACT

The invention intends to simplify the connecting operation of an insulated wire and a pin terminal, and to reduce the cost of connection. A spiral part of the insulated wire having a spiral end according to the invention is formed by removing an insulation at an end of the insulated wire to expose a conductor, and winding the exposed conductor into a spiral form by 1.5 folds or more to produce a spiral part. The insulated wire and the pin terminal are connected in such a manner that the pin terminal is inserted into the central opening of the spiral part, and the spiral part and the pin terminal are fixed with a fixing material, such as solder, or binding agent having a high conductivity. When a solder coating is formed on the conductor in the spiral part, it is possible to fix the spiral part and the pin terminal only by heating the spiral part to melt the coating solder.

12 Claims, 5 Drawing Sheets

FIG. 7(A)
(PRIOR ART)
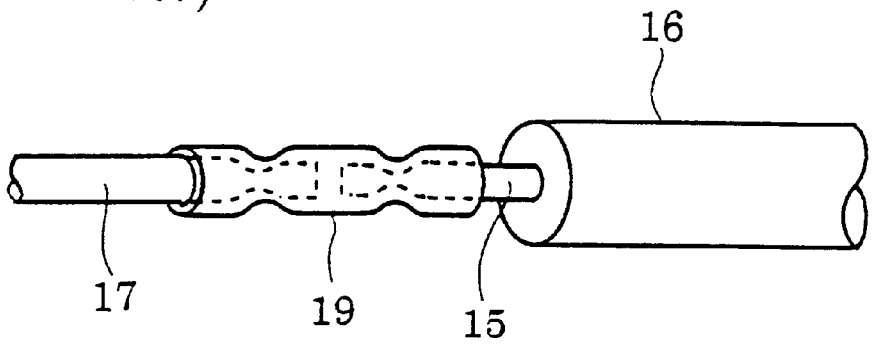
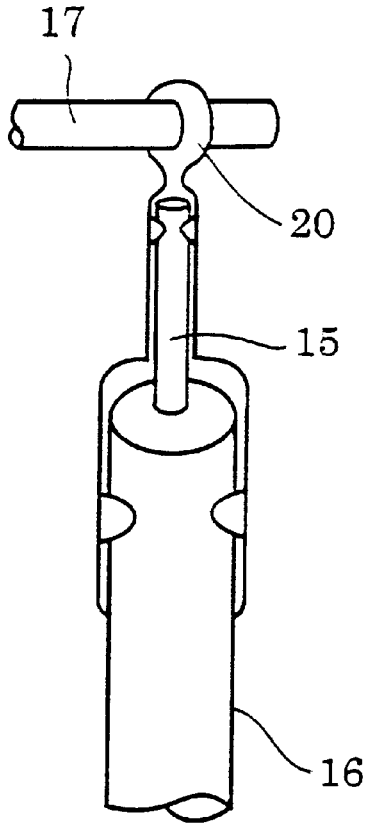
FIG. 7(B)
(PRIOR ART)
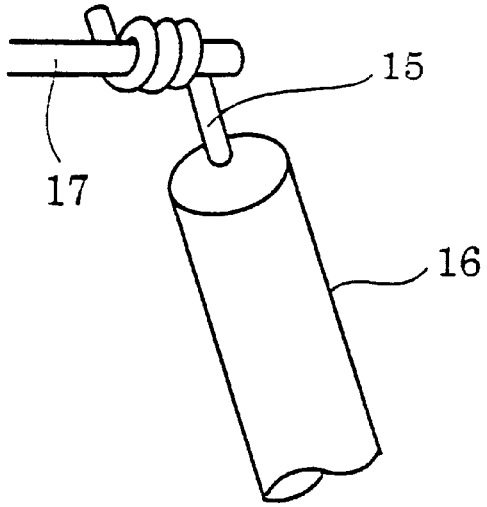
FIG. 7(C)
(PRIOR ART)

INSULATED WIRE HAVING SPIRAL END AND METHOD FOR CONNECTING THE SAME

BACKGROUND OF THE INVENTION

1. Field of the Invention

The present invention relates to an insulated wire having a spiral end to be used in connecting, for example, to a pin terminal of an electronic device, and a method for connecting the insulated wire.

2. Description of the Related Art

In recent years, electronic devices have become increasingly miniaturized.

Therefore, connecting a conductor of an insulated wire to a pin terminal, for example, requires that the connecting part itself be compact and the operation for connecting be conducted in a narrow space.

Furthermore, it is also required that the workability be good, the operating cost be low, and the cost of parts used for connecting be low. In addition, in order to protect the parts to be connected through a pin terminal from heat, the parts must not be heated for a prolonged period of time during the connecting operation. Additionally, in order to prevent the formation of sparks on application of high voltage, the connecting part should have no protrusions, the contact resistance should be small, and the strength of the connecting part should be large enough to prevent from releasing easily.

However, in view of the requirements described above, the connecting methods of the related arts involve many problems. Various connecting methods of the related arts and problems thereof are described below with reference to FIGS. 6A and 6B and FIGS. 7A to 7C. In these figures, numeral 15 denotes a conductor, 16 denotes an insulated wire, 17 denotes a pin terminal, 18 denotes solder, 19 denotes a caulking sleeve, 20 denotes a caulking terminal.

In the connecting method shown in FIGS. 6A and 6B, a tip end of a conductor 15, exposed by removing insulation at an end of an insulated wire 16, is accompanied by a pin terminal 17 as shown in FIG. 6A, and then the pin terminal 17 and the conductor 15 are fixed with solder 18 as shown in FIG. 6B.

This connecting method involves the following problems. The workability is poor because, in order to solder a holding fixture to accompany the conductor and the pin terminal, an operator must be skilled in soldering; poor soldering brings about inferior connection strength. Also, there is a possibility that the pin terminal will be heated during soldering for a protracted time.

In the connecting method shown in FIG. 7A, a conductor 15 exposed by removing insulation at an end of an insulated wire 16 and a pin terminal 17 are inserted into a caulking sleeve 19 respectively from both ends thereof, and the caulking sleeve 19 is crimped from the outside thereof to fix the conductor 15 and the pin terminal 17 inside the caulking sleeve 19.

This connecting method also has problems.

The caulking sleeve 19, which is required for the connection, is expensive, the length of the connecting part becomes elongated because of the use of the caulking sleeve 19, and a space is required into which a crimping tool must be inserted upon making the connection.

In the connecting method shown in FIG. 7B, a caulking terminal 20 having a ring is fixed at a tip end of a conductor 15 exposed by removing insulation at an end of an insulated wire 16. At this time, the conductor 15 and the insulated wire 16 are respectively clamped with claws equipped at two positions on the caulking terminal 20. A pin terminal 17 is inserted in the ring of the caulking terminal 20, and the pin terminal 17 and the ring are then fixed by soldering (not shown in the figure).

This connecting method involves the following problems. After the pin terminal and the ring are soldered, the connection strength is insufficient because the ring is of a single fold; a caulking terminal 20 having a ring, which is required for making this connection, is expensive; and there is a possibility that the pin terminal will be heated for a protracted period of time during soldering.

In the connecting method shown in FIG. 7C, a tip end of a conductor 15 exposed by removing insulation at an end of an insulating wire 16 is wound several times around a pin terminal 17, and the conductor 15 and the pin terminal 17 are then fixed by soldering (not shown in the figure).

This connecting method involves the following problems. Specifically, space is required for winding the conductor; there is a possibility that the pin terminal will be heated for a long time during soldering; and a protrusion of solder is liable to form at the connecting part because soldering is conducted after winding the conductor.

SUMMARY OF THE INVENTION

It is an object of this invention to provide a method for easily connecting a conductor of an insulated wire to a pin terminal at low cost while removing, to the extent possible, the problems associated with the related art connecting methods as described above. Another object of this invention is to provide an insulated wire having a spiral end for performing the connecting method of the invention.

The invention relates to an insulated wire having a spiral end produced by a process comprising removing insulation at an end of an insulated wire to expose a conductor; and winding the exposed conductor into a spiral form by 1.5 folds or more to produce a spiral part at an end of the conductor.

The insulated wire having a spiral end can be easily connected to a pin terminal by inserting a pin terminal into a central opening of the spiral part, and fixing the spiral part and the pin terminal with a fixing material, such as solder or a binding agent having a high conductivity.

It is possible that a solder coating may be previously formed on the spiral part of the conductor, and after inserting the pin terminal into the central opening of the spiral part, the spiral part can then be heated to electrically connect the pin terminal and the insulated wire having a spiral end by melting the solder coating. In this case, the heating time is short, and the workability is improved, so that an electronic device, such as a cold cathode tube, to which the pin terminal is connected, is not damaged by heat. Furthermore, the contact resistance at the connecting part can be made small, and the fixing strength at the connecting part can be increased.

In the case where a stranded wire is used as the conductor, it is preferred that the spiral part have a spiral direction opposite to a stranding direction of the stranded wire, whereby unraveling of the stranded wire can be prevented on forming the spiral part.

BRIEF DESCRIPTION OF THE DRAWINGS

FIGS. 7A to 7C are perspective views showing other examples of connecting a conductor of an insulated wire and a pin terminal according to the related art techniques.

DESCRIPTION OF THE PREFERRED EMBODIMENTS

Figure 1A:
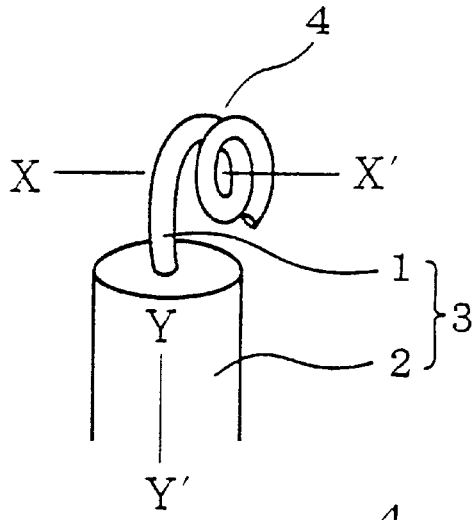
FIGS. 1A and 1B are perspective views showing embodiments of an insulated wire having a spiral end according to the invention.

FIGS. 1A to 1D, 2A and 2B are perspective views and elevated views showing embodiments of an insulated wire having a spiral end according to the invention. In the figures, numeral 1 denotes a conductor, 2 denotes insulation, 3 denotes an insulated wire, and 4 denotes a spiral part.

As the insulation, plastics, for example, flame-retardant polyolefin is used. But, in this invention, the material of the insulation is not particularly limited.

The spiral part 4 can be formed in such a manner that the insulation 2 at an end of the insulated wire 3 is removed to expose the conductor 1, and the exposed conductor 1 then is wound around a machining pin into a spiral form.

FIGS. 1A to 1D show embodiments where the central axis X–X' of the spiral part 4 intersects the central axis Y–Y' of the insulated wire 3 at substantially right angles. In the embodiment shown in FIG. 1A, the spiral part 4 is wound by 2 folds, and in the embodiment shown in FIG. 1B, the spiral part 4 is wound by 3 folds. In the case where the spiral part 4 is wound by 1.5 folds or more, when a pin terminal inserted into a central opening of the spiral part 4 is slanted in any direction, the pin terminal contacts with the spiral part 4 at three positions, so as to limit the slant of the pin terminal.

When the spiral part 4 is wound by 2 folds or more, the angle formed by the pin terminal inserted into the spiral part 4 is farther limited, to stabilize temporary fixing. When the spiral part 4 is wound by 5 folds or more, on the other hand, it is not preferred because the process for forming the spiral part 4 becomes complicated, and the workability of inserting the pin terminal becomes poor.

Figure 1B:
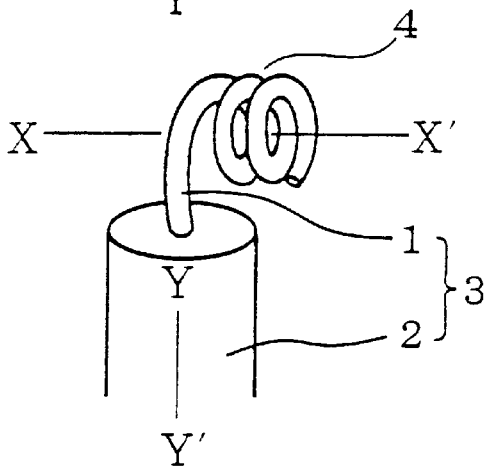
Figure 1C:
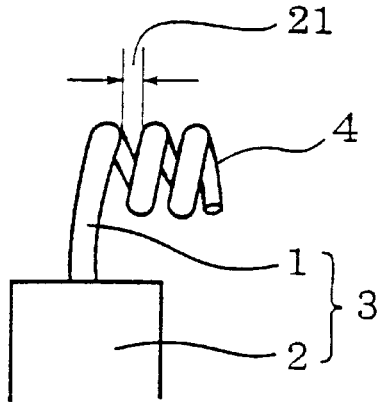
FIG. 1C is an elevational view showing the embodiment of FIG. 1B

FIG. 1C is an elevated view of the embodiment shown in FIG. 1B, in which numeral 21 denotes a gap of the spiral part 4. The gap 21 of the spiral part 4 is preferably from 0 to 0.1 mm, and more preferably from 0 to 0.05 mm. When the gap 21 is too large, the pin terminal may be caught on the spiral part 4 when inserting the pin terminal into the central opening, so as to deteriorate the workability of insertion.

Figure 1D:
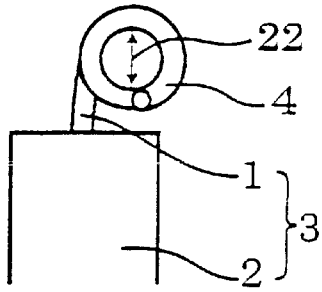
FIG. 1D is an elevated view of the embodiment in FIG. 1B shown from another direction.

FIG. 1D is an elevated view of the embodiment shown in FIG. 1B from another direction, in which numeral 22 denotes an inner diameter of the spiral part 4. The inner diameter 22 is preferably from −0.5 to +2 mm, and more preferably from −0 to +1 mm, of the outer diameter of the pin terminal to be inserted. When the inner diameter 22 of the spiral part 4 is too small, the workability of inserting the pin terminal is deteriorated, and when the inner diameter 22 of the spiral part 4 is too large, the workability of soldering is deteriorated.

Figure 2A:
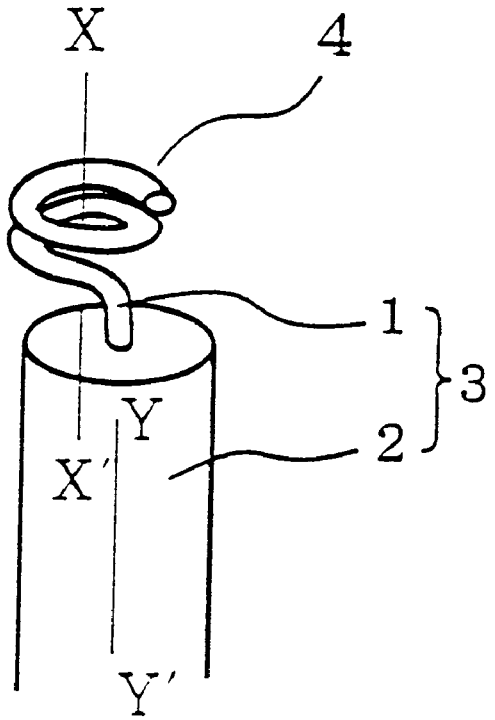
FIGS. 2A and 2B are perspective views showing other embodiments of an insulated wire having a spiral end according to the invention.
Figure 2B:
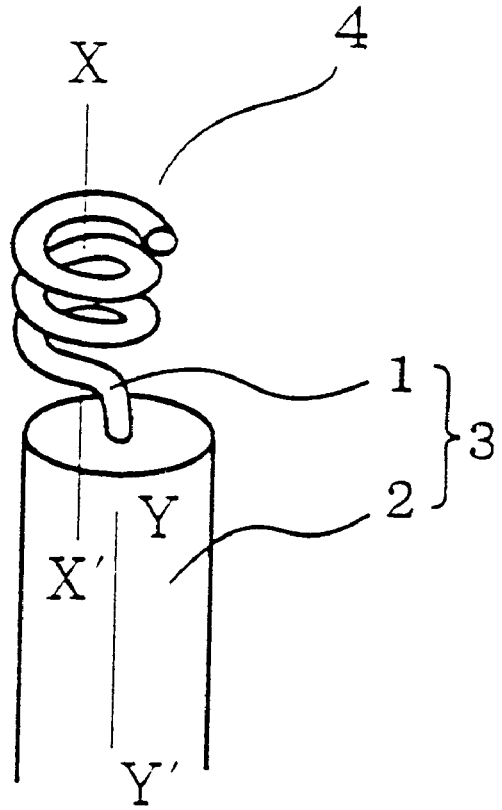

FIGS. 2A and 2B show other embodiments of the insulated wire 3, in which the central axis X–X' of the spiral part 4 and the central axis Y–Y' of the insulated wire 3 are substantially parallel. In the embodiment shown in FIG. 2A, the spiral part 4 is wound by 2 folds, and in the embodiment shown in FIG. 2B, the spiral part 4 is wound by 3 folds.

The central axis X–X' of the spiral part 4 may be in a slanted direction with respect to the central axis Y–Y' of the insulated wire 3.

In the case where the central axis X–X' of the spiral part 4 and the central axis Y–Y' of the insulated wire 3 are substantially parallel, a pin terminal can be inserted into a central opening of the spiral part 4 by simply pushing the insulated wire 3 in the direction of the pin terminal by hand, and the operation of inserting the pin terminal into the spiral part 4 can be easily conducted.

The embodiment in which the central axis X–X' of the spiral part 4 intersects the central axis Y–Y' of the insulated wire 3 at substantially right angles is very convenient in the case where a device is arranged so as to occupy the whole width of an apparatus, and a wire 3 has to be connected to a pin terminal at right angles, for example, in the case of connection at a terminal of a backlight of a liquid crystal display of an electronic apparatus.

A copper stranded wire or a tinned copper stranded wire, comprising 7 strands of 0.1 mm wire, or 19 strands of 0.16 mm wire, may be used as the conductor of the insulated wire.

A copper single wire and a tinned copper single wire, having a diameter of from about 0.2 to 0.6 mm, may also be used as the conductor.

In this invention, however, the size or the material of the conductor is not particularly limited.

Figure 3A:
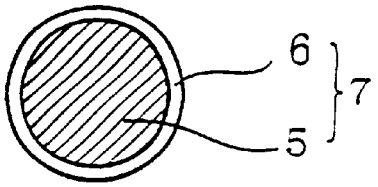
FIGS. 3A and 3B are cross sectional views showing embodiments of a conductor having a solder coating.
Figure 3B:
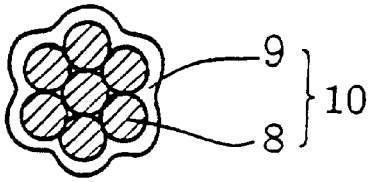

FIGS. 3A and 3B are cross sectional views showing embodiments of a conductor having a solder coating, in which numeral 5 denotes a tinned copper single wire, 6 denotes a solder coating, 7 denotes a conductor, 8 denotes a tinned copper stranded wire, 9 denotes a solder coating, and 10 denotes a conductor. While the solder coatings 6 and 9 may be formed on the whole lengths of the conductors 7 and 10, respectively before covering with insulation, it is preferred, for reducing the cost of the insulated wire, that after the insulation is removed at the end of the insulated wire to expose the conductor, the exposed conductor is dipped in a solder bath to form a solder coating only on the exposed part, and then the spiral part is formed.

It is also possible that after forming the spiral part with the conductor, the spiral part can then be dipped in a solder bath to form a solder coating only on the spiral part.

Figure 4A:
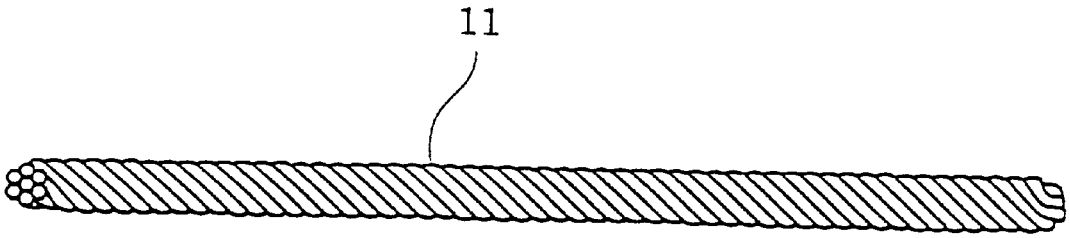
FIG. 4A is a perspective view showing a conductor comprising a stranded wire.
Figure 4B:
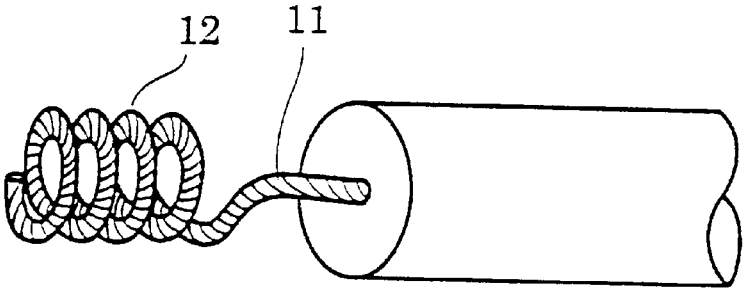
FIG. 4B is a perspective view showing an insulated wire having a spiral end comprising an insulated wire having a stranded conductor.

FIG. 4A is a perspective view showing a conductor comprising a stranded wire, and FIG. 4B is a perspective view showing an insulated wire having a spiral end wherein the spiral end of the insulated wire is made from the stranded conductor. A stranded wire of the conductor 11 shown in FIG. 4A is of a right-hand lay (Z-twisted), whereas the spiral part 12 of the insulated wire, as shown in FIG. 4B, is of left-hand lay (S-twisted). When the stranding direction of the conductor 11 and the spiral direction of the spiral part 12 are opposite to each other, unraveling of the stranded wire can be prevented when forming the spiral part. In the case of an insulated wire comprising a stranded wire having insulation thereon, it is possible that the strand will be unraveled on removing the insulation at the end of the wire. In such a case, the spiral part is formed after twisting the conductor by hand. It is possible to form the solder coating after twisting, and then forming the spiral part.

In electronic equipment, such as a portable personal computer, a long and narrow cold cathode tube having a diameter of several millimeters is used for the backlight of a liquid crystal display. The cold cathode tube has a pin terminal comprising a copper-plated iron-nickel alloy wire having a diameter of about 0.4 to 0.8 mm and a length of about 3 to 10 mm, which is generally called a "Jumet wire." In order to supply electric power to the cold cathode tube, it is necessary to connect the pin terminal to an electric wire.

A plastic insulated wire having an outer diameter of about 1.0 to 2.0 mm, including a conductor having 7 strands of 0.1 mm wire or 19 strands of 0.16 mm wire, is employed as the electric wire for supplying electric power.

Figure 5:
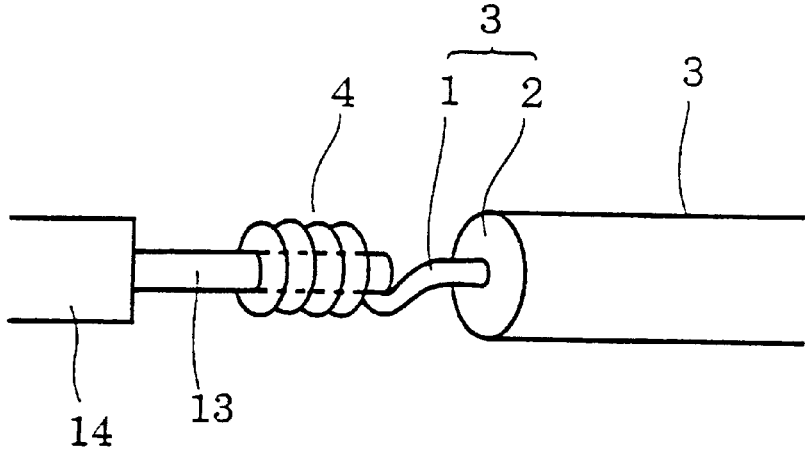
FIG. 5 is a perspective view showing an example of a connecting part using an insulated wire having a spiral end according to the invention.
Figure 6A:
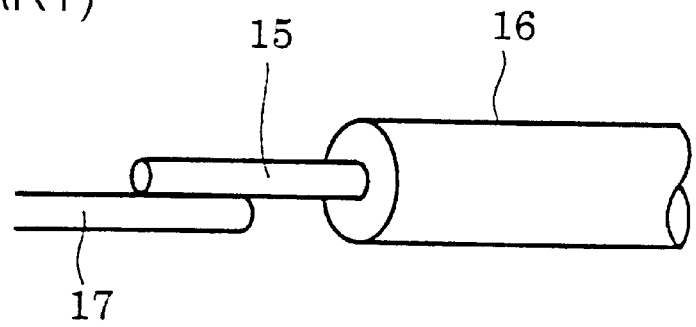
FIG. 6(A) (PRIOR ART)
FIGS. 6A and 6B are perspective views showing an example of connecting a conductor of an insulated wire and a pin terminal according to the related art techniques.
Figure 6B:
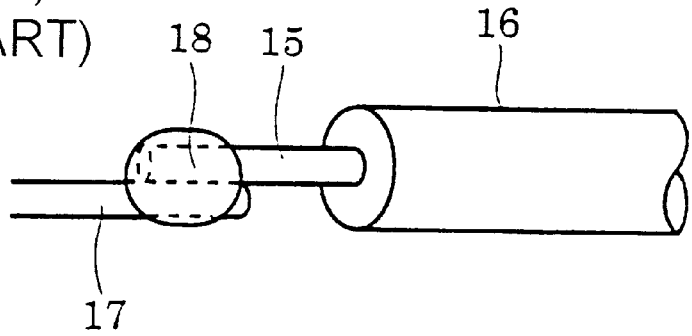
FIG. 6(B) (PRIOR ART)

FIG. 5 is a perspective view showing an example of a connecting part using the insulated wire having a spiral end according to the invention for a backlight of a liquid crystal display of a portable computer. In FIG. 5, numeral 13 denotes a pin terminal, 14 denotes a cold cathode tube, and the other numerals have the same meanings as in FIGS. 1A to 1D. The pin terminal 13 is inserted into a central opening of the spiral part 4 of the insulated wire 3 having a spiral end, and fixed thereto with a fixing material, such as solder, not shown in the figure. At the time when the pin terminal 13 is inserted into the central opening of the spiral part 4, because the insulated wire 3 is retained by the pin terminal 13 (temporary fixing), it is not necessary to hold the conductor 1 of the insulated wire 3 with a specific tool such as a pinchers, and therefore, the fixing operation with a fixing material such as solder can be easily conducted.

In the case where the pin terminal 13 is a leader line of the cold cathode tube 14, and the heating time for soldering or the like is required to be shortened, it is possible that a solder coating can be previously formed on the conductor 1 in the spiral part 4, and after inserting the pin terminal 13 into the central opening of the spiral part 4, the solder coating can be melted by heating the spiral part 4 to fix the conductor 1 in the spiral part 4 to the pin terminal 13. By using this procedure, the heating time can further be shortened, and there is no fear of damaging the cold cathode tube, etc. by heat. Furthermore, because the solder spreads over the whole circumference of the pin terminal and the whole circumference of the spiral part 4, the pin terminal 13 and the conductor 1 are firmly fixed to each other. The fixing strength of the conductor 1 to the pin terminal 13 can further be increased by soldering to the connecting part, in addition to the fixation by melting the coating solder.

While an example where the pin terminal 13 is fixed to the cold cathode tube 14 is shown in FIG. 5, the pin terminal 13 may part of any suitable apparatus.

What is claimed is:

1. An insulated wire having a spiral end produced by a process comprising removing an insulation at an end of said insulated wire to expose a conductor; and winding the exposed conductor into a spiral form with gaps of 0 to 0.1 mm by 1.5 folds to 3 folds to produce a spiral part at said end of the conductor;

wherein a central axis of the spiral part and a central axis of the insulated wire are substantially parallel.

2. An insulated wire having a spiral end as claimed in claim 1, wherein the conductor in at least the spiral part has a solder coating.

3. An insulated wire having a spiral end as claimed in claim 1, wherein the conductor is a stranded wire, and the spiral part has a spiral direction opposite to a stranding direction of the stranded wire.

4. An insulated wire having a spiral end as claimed in claim 1, wherein the spiral part has 2 folds.

5. An insulated wire having a spiral end as claimed in claim 1, wherein the spiral part has 3 folds.

6. An insulated wire having a spiral end as claimed in claim 1, wherein the spiral gaps are from 0 to 0.05 mm.

7. A method for connecting an insulated wire having a spiral end with gaps of 0 to 0.1 mm comprising the steps of: inserting a pin terminal into a central opening of a spiral part of said insulated wire having said spiral end; and fixing the spiral part and the pin terminal with a fixing material, the insulated wire having said spiral end being produced by a process comprising removing a covering at an end of said insulated wire to expose a conductor; and winding the exposed conductor into a spiral form by 1.5 folds to 3 folds to produce the spiral part at the end of the conductor;

wherein a central axis of the spiral part and a central axis of the insulated wire are substantially parallel.

8. A method for connecting an insulated wire having a spiral end as claimed in claim 7, wherein the conductor in at least the spiral part has a solder coating, and after inserting the pin terminal into the central opening of the spiral part, the spiral part and the pin terminal are fixed by heating and melting the solder coating.

9. An insulated wire having a spiral end produced by a process comprising removing an insulation at an end of said insulated wire to expose a conductor; and winding the exposed conductor into a spiral form with gaps of 0 to 0.1 mm by 2 folds to 3 folds to produce a spiral part at said end of the conductor;

wherein a central axis of the spiral part and a central axis of the insulated wire are substantially parallel.

10. An insulated wire having a spiral end as claimed in claim 9, wherein the conductor in at least the spiral part has a solder coating.

11. An insulated wire having a spiral end as claimed in claim 9, wherein the conductor is a stranded wire, and the spiral part has a spiral direction opposite to a stranding direction of the stranded wire.

12. An insulated wire having a spiral end as claimed in claim 9, wherein the spiral gaps are from 0 to 0.05 mm.

* * * * *